US006158678A

United States Patent [19]

Lange

[11] Patent Number: 6,158,678

[45] Date of Patent: Dec. 12, 2000

[54] APPARATUS FOR APPLYING FLUIDS TO VARIOUS TYPES AND LOCATIONS OF SURFACES

[75] Inventor: Michael R. Lange, Minnetonka, Minn.

[73] Assignee: Sky Robotics, Inc., St. Paul, Minn.

[21] Appl. No.: 09/118,157

[22] Filed: Jul. 16, 1998

Related U.S. Application Data

[60] Provisional application No. 60/053,472, Jul. 23, 1997.

[51] Int. Cl.[7] ..... B05B 15/06

[52] U.S. Cl. ..... 239/532; 239/104; 239/225.1; 239/251; 239/722; 239/753

[58] Field of Search ..... 239/104, 120, 239/121, 225.1, 251, 265, 280, 280.5, 281, 722, 753, 532, 587.1; 15/50.1

[56] References Cited

U.S. PATENT DOCUMENTS

| | | | |
|---|---|---|---|
| 1,592,882 | 7/1926 | Artas . | |
| 1,943,606 | 1/1934 | Hawley | 15/50.1 X |
| 2,312,189 | 2/1943 | Petley . | |
| 3,056,153 | 10/1962 | Laughter, Sr. . | |
| 3,236,455 | 2/1966 | Lewis et al. | 239/11 |
| 3,321,331 | 5/1967 | McNeely | 15/50.1 X |
| 3,748,050 | 7/1973 | Poppitz | 239/251 X |
| 3,832,069 | 8/1974 | Petsch | 239/251 X |
| 4,191,589 | 3/1980 | Halls et al. | 239/251 X |
| 4,903,364 | 2/1990 | Long | 15/50.1 |
| 5,028,004 | 7/1991 | Hammelmann | 239/120 |
| 5,029,758 | 7/1991 | Chayer | 239/280 X |
| 5,336,012 | 8/1994 | Newville | 239/281 X |
| 5,456,412 | 10/1995 | Agee | 239/104 |
| 5,619,766 | 4/1997 | Zhadanov et al. . | |
| 5,769,324 | 6/1998 | Lenhart | 239/532 X |

OTHER PUBLICATIONS

"Water Jet" brochure, Landa Inc., 9/95.

"Whisper Wash" advertisement, Power Washers of North America, *CleanerTimes*, Mar. 1998, page 51.

*Primary Examiner*—Andres Kashnikow
*Assistant Examiner*—Robin O. Evans
*Attorney, Agent, or Firm*—Dorsey & Whitney LLP

[57] ABSTRACT

The present invention relates to an apparatus designed to apply cleaning fluids to all types of surfaces and to apply those fluids to vertical, horizontal, angled, and overhead surfaces. The apparatus is designed so that it is able to glide easily over uneven or irregular surfaces. This is possible, in part, because the section of the washing apparatus that dispenses the cleaning fluid is kept in a spaced relationship to the surface being cleaned by the pressure of the cleaning fluid. The apparatus of the present invention includes a spraying unit, a support assembly and a bottom control unit. The spraying unit includes a housing, a swivel, and a spray bar having nozzles rotatably connected the housing. The support assembly includes an adjustable pole hingedly connected to the spraying unit at one end. The bottom control unit includes a base that is hingedly connected to the pole at its other end. At least one high pressure fluid line is connected to the spray bar.

19 Claims, 3 Drawing Sheets

APPARATUS FOR APPLYING FLUIDS TO VARIOUS TYPES AND LOCATIONS OF SURFACES

This application is based on U.S. Provisional Application No. 60/053,472 filed Jul. 23, 1997, and claims under 35 U.S.C. §119(e), the benefit of U.S. Provisional Application No. 60/053,472.

SUMMARY OF THE INVENTION

The present invention relates to an apparatus for applying any substance that has fluid properties to surfaces. More specifically, the present invention relates to an apparatus designed to apply cleaning fluids to all types of surfaces and to apply those fluids to vertical, horizontal, angled, and overhead surfaces. The present invention is a washing apparatus that is lightweight, portable, and mobile.

The present invention is designed so that it is able to glide easily over uneven or irregular surfaces. This is possible, in part, because the section of the washing apparatus that dispenses the cleaning fluid is kept in a spaced relationship to the surface being cleaned by the pressure of the cleaning fluid. The cleaning apparatus is not limited to cleaning only building surfaces, it can also clean for example: storage tanks, ships, and aircraft.

The apparatus of the present invention includes a spraying unit, a support assembly and a bottom control unit. The spraying unit includes a housing, a swivel, and a spray bar having nozzles rotatably connected the housing. The support assembly includes an adjustable pole hingedly connected to the spraying unit at one end. The bottom control unit includes a base having one or more wheels. The base is hingedly connected to the pole at its other end. At least one high pressure fluid line is connected to the spray bar.

The apparatus of the present invention creates a hovering effect by using water pressure that keeps the spraying unit a spaced relationship from the surface being cleaned. The washing apparatus of the present invention can wash all surfaces both inside and out, and has the capacity to clean through screens. The washing apparatus is designed to clean those surfaces that are difficult to reach or may have obstacles in its path.

Thus, it is an object of the present invention to provide an apparatus and for cleaning all surfaces of a building, inside and out, including: ceilings, floors, inside walls, outside walls, windows and roofs.

DETAILED DESCRIPTION OF THE INVENTION

Figure 1:
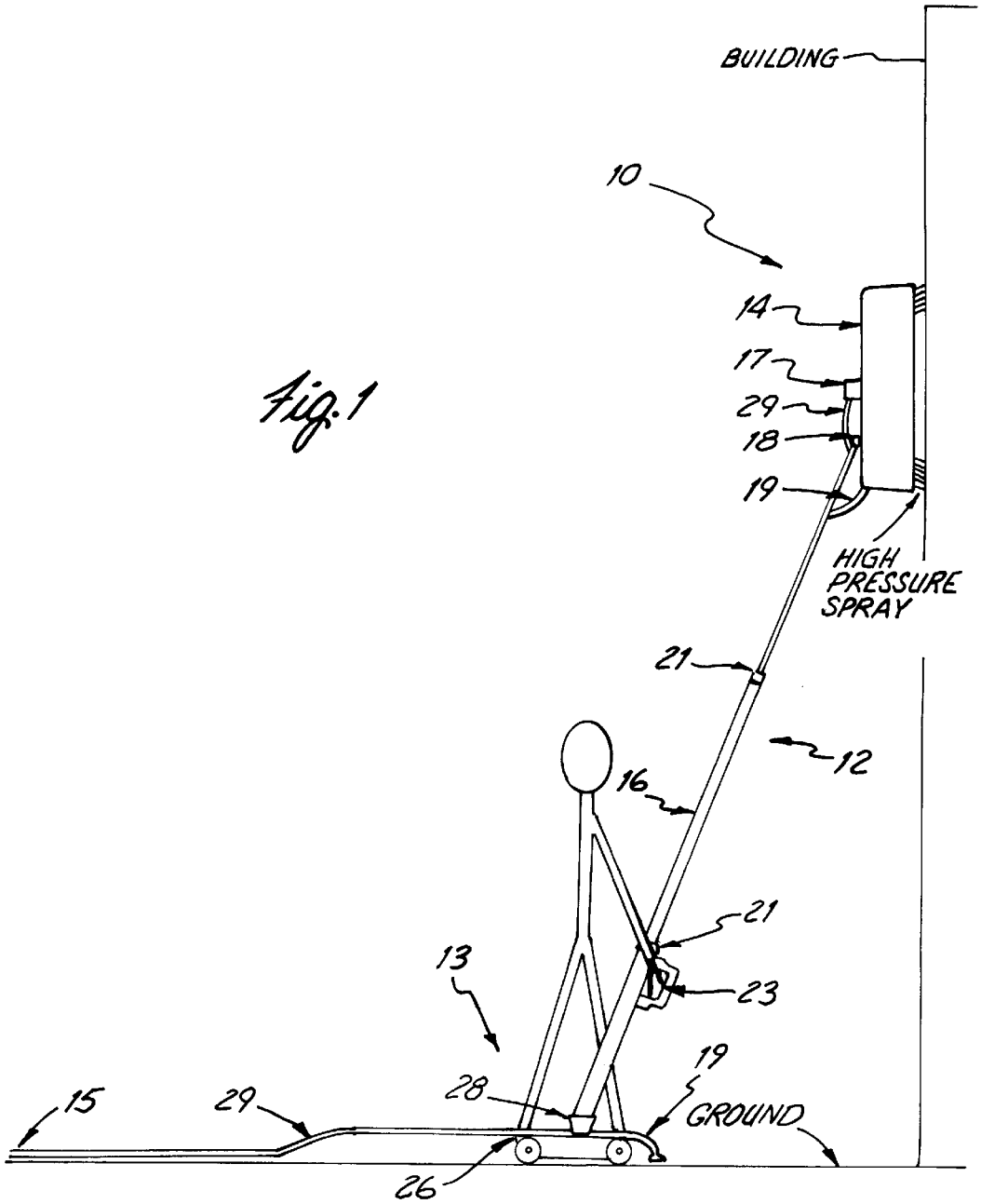
FIG. 1 is a side view of a washing apparatus of the present invention cleaning the side of a building and depicts a person (stick figure) using it.
Figure 2:
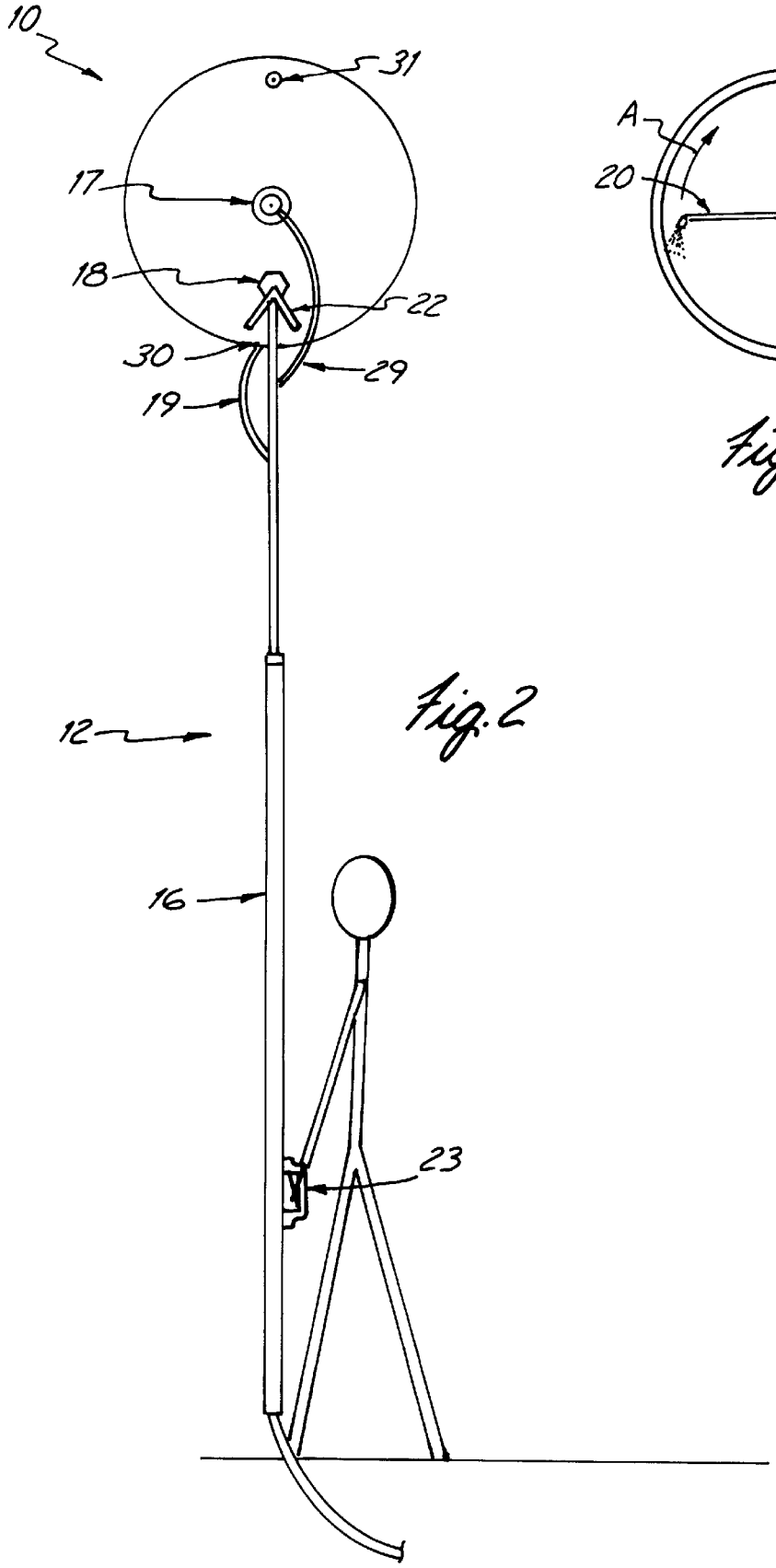
FIG. 2 is a top view of a washing apparatus of the present invention without the bottom control unit and depicts a person (stick figure) using it.
Figure 2A:
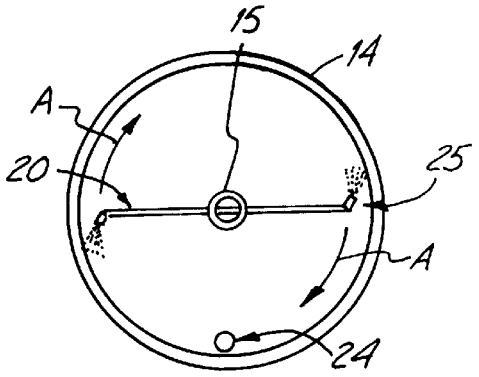
FIG. 2*a* is a bottom view of the spraying unit showing the spray bar dispensing fluids under pressure and the direction of travel of the spray bar with Arrows A.

As seen in FIGS. 1–2*a,* the washing apparatus of the present invention includes a spraying unit 10, a support assembly 12, a bottom control unit 13, various fluid hoses, and a pressure washing unit (not shown) which can, for example, pressurize fluids, deionize or purify water and inject cleaning agents into the water or other fluids, a pump, or simply a garden hose connected to a city water supply (both also not shown). A remote control unit could also be used to operate the present invention from a distance. A pressure washing unit that is commercially available is one marketed by Rhino Industries in Bloomington, Minn.

Figure 3:
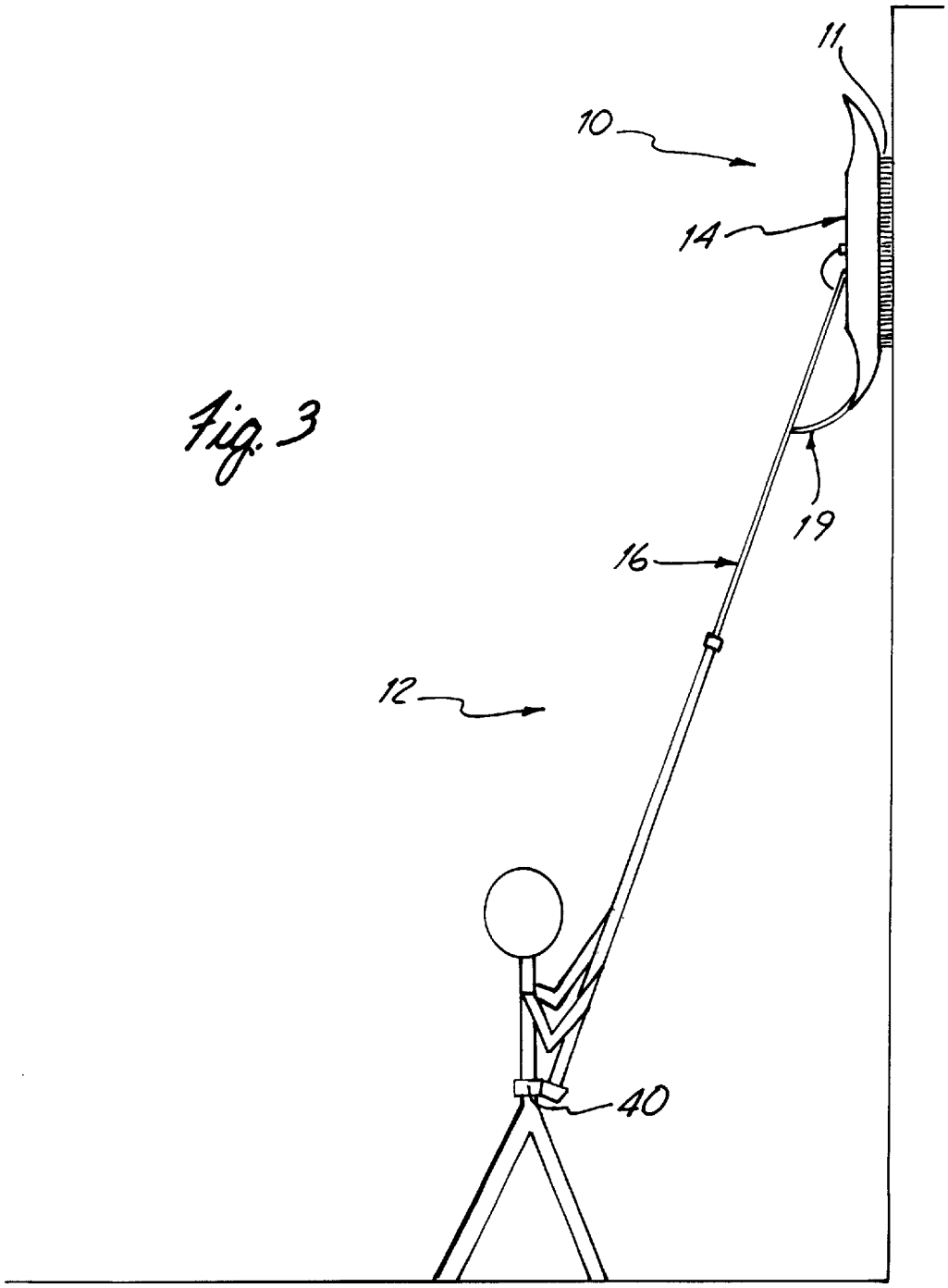
FIG. 3 is a side view of a washing apparatus of the present invention cleaming the side of a building and depicts a person (stick figure) wearing a belt that includes a telescoping pole holder for receiving the pole instead of a bottom control unit, and shows an embodiment of the shroud that has bristles attached to the outer edge of the shroud. (The high pressure spray depicted in FIG. 1 is not shown in this figure, so as not to cause confusion with the bristles).

The spraying unit 10 includes a housing or "shroud" 14 a swivel 17, at least one fluid spray bar 20 having at least one spray nozzle 25, one hinge 18 that is removably attached to the support assembly 12, and a drain tube 19. The spray bar 20 along with off-set Rotomax rotary nozzles 25 are commercially available at General Pump in Mendota Heights, Minn. The swivel 17 is fixed to the housing 14 and to the spray bar 20 as shown in FIG. 2*a*. Swivels 17 that can be used are commercially available from various companies such as Rhino Industries, Bloomington, Minn. (part number SM9018F8MB), and Mosmatic Corporation, Bristol, Wis. (part number 33.163). The shroud 14 is made of a resilient material, but rigid material such as a plastic. The outer edge of the shroud 14 nearest the surface being cleaned can be lined with bristles, felt or other materials 11 to act as a curtain as seen in FIG. 3. This curtain will reduce the amount of fluids that splash on the surrounding surfaces, will act as a cushion between the shroud and the surface being cleaned, and will enhance the hoovering effect created by the cleaning fluid pressure.

The support assembly 12 consists of a telescoping pole 16 having at least one hose attachment fitting 15, two (2) adjustment knobs 21, and a spray trigger and handle 23. The support assembly 12 has an aperture that allows the shroud hinge 18 to attach to it. There is also a spring connection 22 that is mounted on the telescoping pole 16 and the shroud 14. The spring 22 operates as a stabilizer to keep the shroud 14 in a vertical (upright) position when cleaning vertical surfaces. When a vertical surface being washed is uneven, it is possible for the water pressure to off-balance the shroud 14 and cause it to tip backwards on the pole 16. The spring 22 creates a tension between the shroud 14 and the pole 16 which eliminates this problem and keeps the spraying unit 10 balanced and the quality of washing high. This spring connection 22 is commercially available at many hardware stores. There is also a drain hose 19 that either runs through the interior of the pole 16 or, when the building is larger, is attached to the outside. This drain hose 19 allows for the disposal of the used fluids that collect in the shroud 14. It should be understood that the preferred method is to have the drain hose 19 run within the inside of the pole, but that running it along the outside also works when it is necessary.

The bottom control unit 13 includes a cart with wheels 26, a pole holder attachment 28, a high pressure hose connection 29, and a drainage connection 30.

In the cleaning process, the spraying unit 10 is connected to the pole 16. The pole 16 is then connected to the bottom control unit 13. Prior to the operation process the shroud 14 is rested on the surface of the building being washed. It should be understood that while there are only three (3) sections of the telescoping pole 16 shown, it is possible to add as many as are necessary to clean the building. If added support is necessary for the cleaning of very large buildings, it is also possible to attach a guide rope (not shown) to the lifting eye 31. The lifting eye 31 can also be used to allow the user to use the spraying unit 10 to clean tall structures. One end of a cable or rope could be attached to the lifting eye 31 and the other end could be attached a pulley system or simply manipulated by hand.

The operator then engages the spray trigger 23 and the pressure washer is activated. As the fluid is forced out of the nozzles 25 of the spraying unit 10, it creates a pressure that causes the spray bar 20 to spin. With this action, washing is completed. The nozzles 25 are selected to maximize the area that is needed to be cleaned.

The used water drains continuously during the washing process carrying much of the dirt and waste from the buildings along with it to the shroud 14 where it flows down the draining hose 19 to the ground. This process keeps the majority of used water from coming in contact with surfaces that have already been cleaned. A water collection trough can be added to the shroud 14. The water collection trough can be made of plastic or made of flexible material enabling the shroud (4) to work at any angle (even upside-down) without adding weight to the system.

The user then guides the spray unit 10 by pushing and pulling the pole 16 along the surface being cleaned while the pressure washer is activated. The process discussed above is then repeated as many times as are necessary to clean the entire surface.

There may be surfaces that do not require the use of the cart with wheels 26 to move the apparatus, such as when a sidewalk or cement driveway is to be cleaned. In those instances, the pole 16 is not connected to the cart with wheels as shown in FIG. 2.

Although a description of the preferred embodiment has been presented, it is contemplated that various changes, including those mentioned above, could be made without deviating from the spirit of the present invention. For example, the present invention could be modified and used for painting or for stripping paint with high pressure water. It should understood that fluids other than paint or water could be used with the present invention and fluids of various temperature ranges could be used to enhance or accomplish the user's objectives. Another variation may be to attach a generally straight brush along the length of the spray bar 20 and/or conically shaped brushes surrounding each nozzle 25. Still yet another variation may be to eliminate the spray bar 20 and swivel 17, and use a single spiral nozzle rotatably connected to the center of the spraying unit 10 shroud 14. An example of a spiral nozzle is the SpiralJet® sold by Spray Systems Company, Wheaton, Ill. Yet another variation would be to mount the spraying unit 10 (without a support assembly 12 and bottom control unit 13) to a mechanical lift, hoist, or similar device, or to construction equipment such as a backhoe or crane. Still yet another variation would be for the user to wear a belt that includes a telescoping pole 16 holder 40 as shown in FIG. 4.

I claim:

1. A portable washing apparatus, comprising:

a spray unit including a shroud, a hose connection fitting, a swivel and a fluid spray bar having least one spray nozzle, said spray bar operably and fixedly attached to said swivel, said swivel rotatable connected to said shroud and operably connected to said hose connection fitting;

a support assembly, said support assembly including a telescoping pole having two ends, and one of said ends of said telescoping pole being hingedly attached to said spray unit; and a spring means for stabilizing said spraying unit when said spraying unit is operating a generally vertical position, said spring means having two ends, one said end of said spring means being removably connected to said spray unit, and the second said end of said spring means being removably connected to said telescoping pole.

2. The portable washing apparatus of claim 1, further comprising a bottom control unit, said bottom control unit including a base and a pole attachment member.

3. The portable washing apparatus of claim 2, wherein said bottom control unit further includes wheels mounted on said base.

4. The portable washing apparatus of claim 3, further comprising a high pressure fluid line, said high pressure fluid line releaseably connected to said hose connection fitting.

5. The portable washing apparatus of claim 4, wherein said spray unit further includes a hinge, said hinge is removably connected to said telescoping pole.

6. The portable washing apparatus of claim 2, wherein said shroud includes a drain hose.

7. A portable washing apparatus, comprising a spray unit including a shroud and a fluid spray bar having at least one spray nozzle, said spray bar operably and fixedly attached to a swivel, said swivel rotatably connected to said shroud and operably connected to a hose connection fitting, a support assembly including a telescoping pole having two ends, one said end being movably connected to said spray unit, and an elastic means for stabilizing said sprying unit when said spraying unit is operating a generally vertical position, said spring means having two ends, one said end of said elastic means being connected to said spray unit, and the second said end of said elastic means being connected to said telescoping pole.

8. The portable washing apparatus of claim 7, wherein said spray unit further includes a hinge, said hinge is removably connected to said pole.

9. The portable washing apparatus of claim 7, wherein said shroud includes a bristle curtain.

10. The portable washing apparatus of claim 7, wherein said spray bar dispenses fluids under sufficient pressure to keep said spray unit in a spaced relationship from the surface being cleaned.

11. The portable washing apparatus of claim 7, further comprising a bottom control unit, said bottom control unit including a base and a pole attachment member.

12. The portable washing apparatus of claim 11, wherein said bottom control unit further includes wheels mounted on said base.

13. The portable washing apparatus of claim 7, further comprising a high pressure fluid line, said high pressure fluid line releaseably connected to said hose connection fitting.

14. A portable washing apparatus, comprising:

a spray unit including a shroud, a fluid spray bar having at least one spray nozzle and a hinge, said spray bar operably and fixedly attached to a swivel, said swivel rotatably connected to said shroud and operably connected to a hose connection fitting;

a support assembly, said support assembly including a telescoping pole having two ends, and one of said ends of said telescoping pole being attached to said hinge of said spray unit;

a bottom control unit, said bottom control unit including a base, a pole attachment member, and wheels mounted on said base;

a high pressure fluid line, said high pressure fluid line releaseably connected to said hose connection fitting;

a spring means for stabilizing said spraying unit when said spraying unit is operating in a generally vertical position, said spring means having two ends, one said end of said spring means being removably connected to said spray unit, and the second said end of said spring means being removably connected to said telescoping pole.

15. The portable washing apparatus of claim 14, wherein said shroud includes a bristle curtain.

16. The portable washing apparatus of claim 14, wherein said spray bar dispenses fluids under sufficient pressure to keep said spray unit in a spaced relationship from the surface being cleaned.

17. The portable washing apparatus of claim 16, wherein said spray bar dispenses fluids under sufficient pressure to keep said spray unit in a spaced relationship from the surface being cleaned.

18. The portable washing apparatus of claim 14, wherein said shroud includes a drain hose.

19. The portable washing apparatus of claim 17, wherein said shroud includes a drain hose.

* * * * *